United States Patent [19]

Dunn

[11] Patent Number: 4,821,440

[45] Date of Patent: Apr. 18, 1989

[54] WEATHERIZED CONSTRUCTION SITE INSPECTION BOARD ASSEMBLY

[76] Inventor: Gary D. Dunn, 2080 Sandpiper Dr., Palm Harbor, Fla. 34683

[21] Appl. No.: 125,958

[22] Filed: Nov. 27, 1987

Related U.S. Application Data

[63] Continuation-in-part of Ser. No. 920,532, Oct. 20, 1986, abandoned.

[51] Int. Cl.[4] ..... G09F 3/18

[52] U.S. Cl. ..... 40/642

[58] Field of Search ..... 40/10 R, 642, 312, 606, 40/607

[56] References Cited

U.S. PATENT DOCUMENTS

| | | | |
|---|---|---|---|
| 1,050,831 | 1/1913 | Hoffman | 40/642 |
| 1,534,151 | 4/1925 | Bashler | 40/642 |
| 1,792,652 | 2/1931 | Morton | 40/642 |
| 1,859,134 | 5/1932 | Poti | 40/642 |
| 2,027,086 | 1/1936 | Brookey | 40/642 |
| 2,127,170 | 8/1938 | Haslam | 40/642 |
| 2,176,253 | 10/1939 | Fogarty | 40/642 |
| 2,315,158 | 3/1943 | Markham | 40/642 |
| 4,356,650 | 11/1982 | Antonczyk | 40/642 |

*Primary Examiner*—Gene Mancene
*Assistant Examiner*—Wenceslao Contreras
*Attorney, Agent, or Firm*—Joseph C. Mason, Jr.

[57] ABSTRACT

The assembly has an interior enclosure formed by a back frame having a U-shaped curl at each outer edge of its top and bottom sides. A four sided hinged cover engages flush with the bottom of each U-shaped curl to prevent water access to the interior of the assembly. A display is presented on a tack board mounted in the interior of the enclosure along with a pocket panel to enclose miscellaneous papers.

12 Claims, 6 Drawing Sheets

WEATHERIZED CONSTRUCTION SITE INSPECTION BOARD ASSEMBLY

DESCRIPTION

PRIOR APPLICATION

This application is a continuation-in-part of my earlier U.S. patent application Ser. No. 920,532, filed Oct. 20, 1986, now abandoned.

TECHNICAL FIELD

This invention relates to a display device. More specifically, it refers to a self-contained weatherproof inspection board enclosure for use at construction sites.

BACKGROUND ART

Display devices for printed material such as shown in U.S. Pat. No. 3,874,103 employ magnetic devices to maintain visual material within the display area and a bubble member to protect the visual material from inclement weather conditions. Another sign element containing magnetic devices is described in U.S. Pat. No. 3,367,049. Neither of these references describe devices that can be conveniently used as a construction site inspection board since they do not combine features of strength and low cost with proper components useful to the construction trade.

SUMMARY OF THE INVENTION

I have solved this problem by creating a weather resistant construction site inspection board that is durable, low cost and structurally designed to provide all the component parts necessary for the construction industry.

My assembly employs a back frame enclosure with a U-shaped curl at each exposed edge. A tack board is mounted within the enclosure for displaying or holding construction documents such as notice of commencement, licenses and construction blueprints. A pocket plate is attached to the bottom of the back frame on its exterior edges to form a pocket. A four sided, hinged cover latches to the U-shaped curl at the bottom of the back frame and presses against the bottom surface of each U-shaped curl.

BRIEF DESCRIPTION OF THE DRAWINGS

The present invention may be best understood by those of ordinary skill in the art by reference to the following detailed description when considered in conjunction with the accompanying drawings in which.

DESCRIPTION OF THE PREFERRED EMBODIMENT

Figure 1:
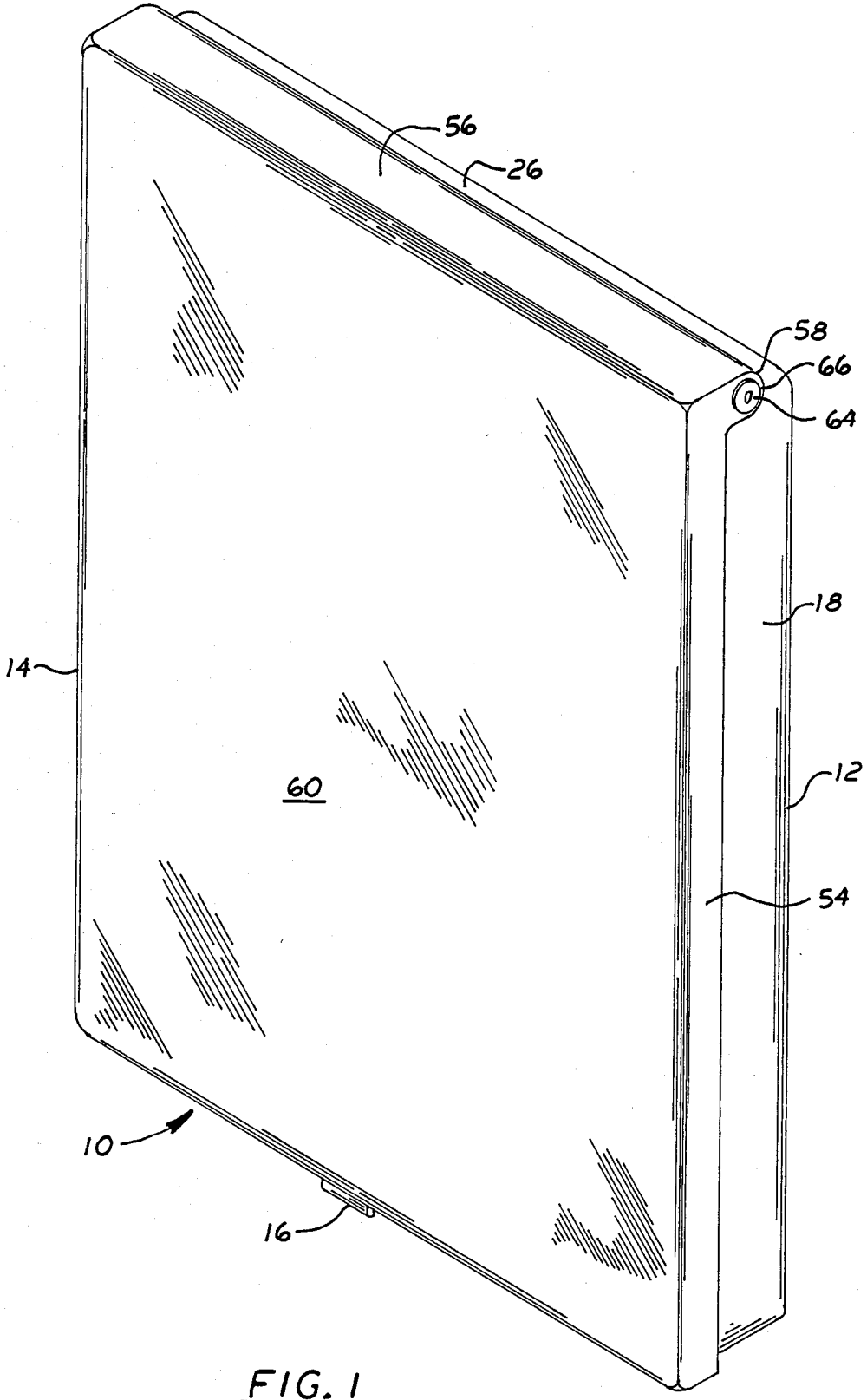
FIG. 1 is a perspective view of the device of this invention.

Referring now to the drawings in which like reference characters designate like or corresponding parts throughout the several views, there is shown in FIG. 1 the weatherized construction site inspection board assembly 10 having a back frame 12 and a four sided cover 14 hinged through grommet 66 in an upper side surface 18 of the back frame 12 and latched by latch 16 to the back frame 12.

The enclosure 20 of the back frame 12 is used to mount a tack board 22 by glue to a back panel 24 which is integral with the side panels 18 of the back frame 12. The back frame 12 is made from a plastic material such as high molecular weight polyethylene or fiberglass. The tack board is made from cork, homasote or polystyrene.

Also integral with the side panels 18 and back panel 24 is top panel 26 and bottom panel 28. Bottom panel 28 has a groove 30 formed between a pair of nipples 32 and 34 on its interior surface 36. A mounting rod 38 joins each side panel 18. A pocket plate 40 fits into groove 30 at a lower end and snaps onto shaft 38 with a pair of integral fingers 42 and 44 at its upper end. The pocket plate 40 forms a pocket 46 for receiving and retaining construction documents.

The back frame 12 can vary in size, but for use on most construction jobs the frame 12 will be twenty-seven inches wide, twenty inches high and three inches in depth.

Figure 3:
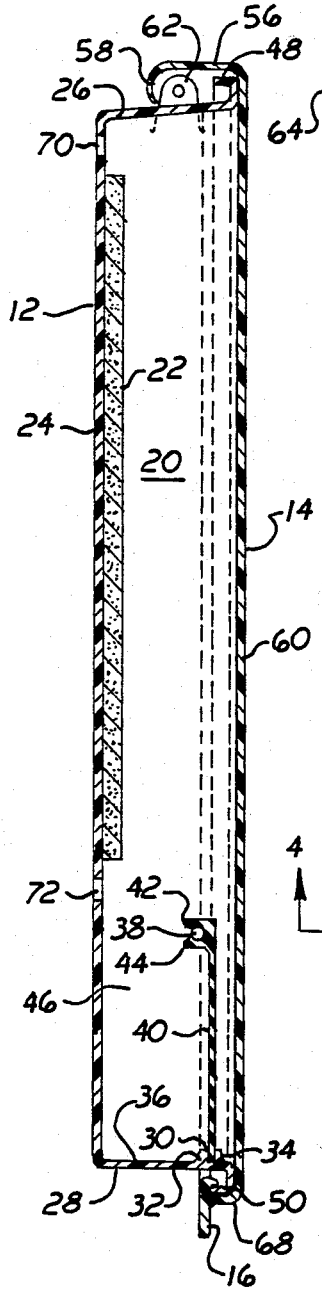
FIG. 3 is a cross section of a side elevation view.
Figure 2:
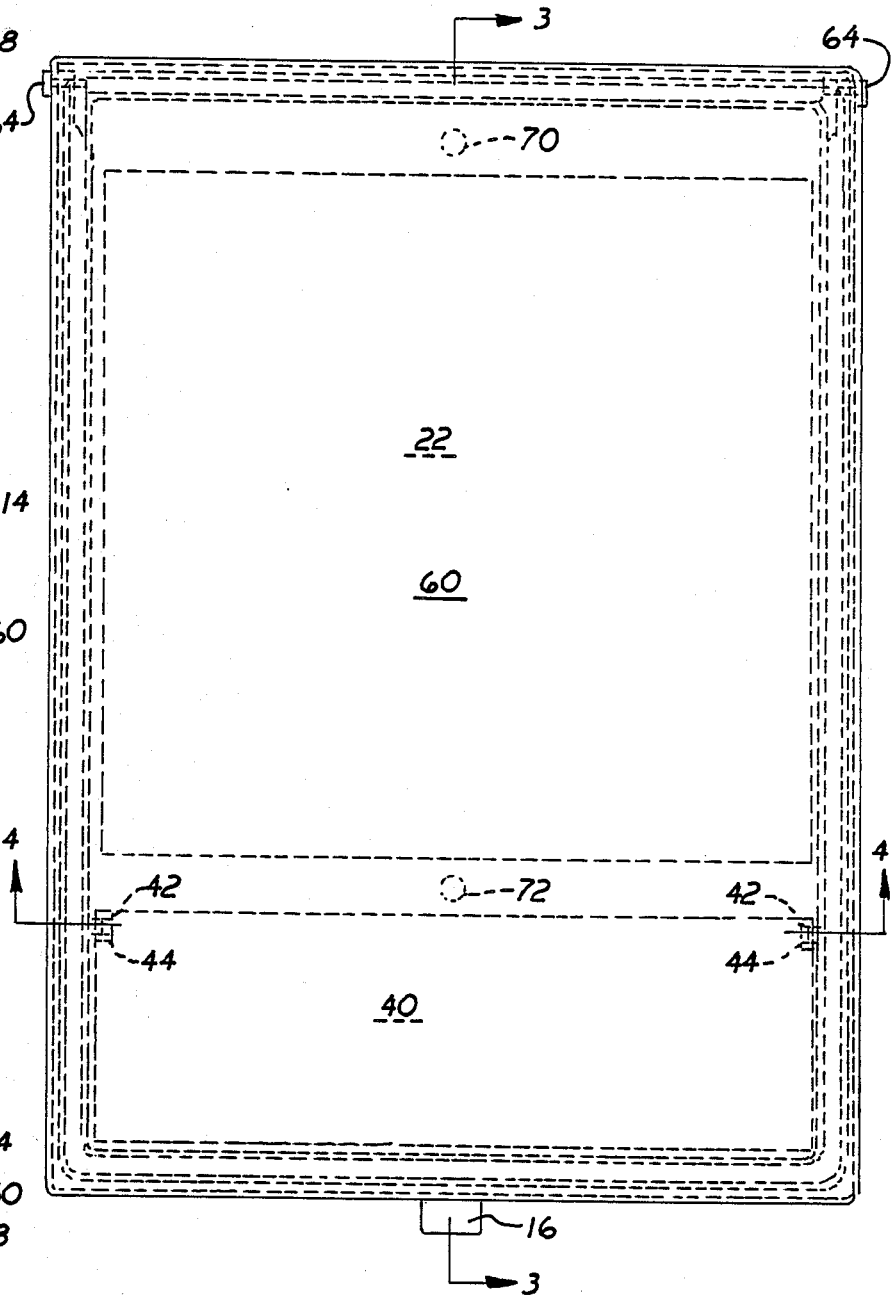
FIG. 2 is a front elevation view partially in phantom.
Figure 4:
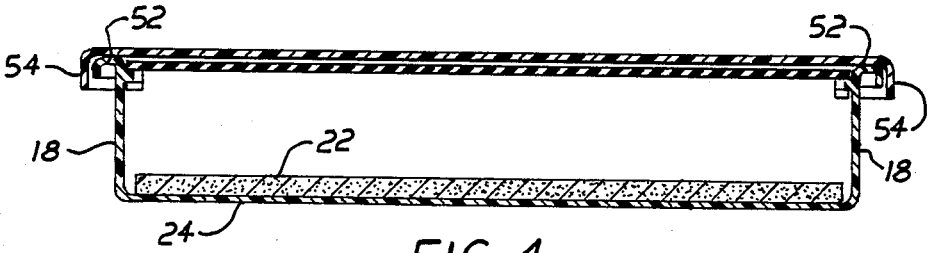
FIG. 4 is a cross section along line 4—4 of FIG. 2 looking upward.
Figure 6:
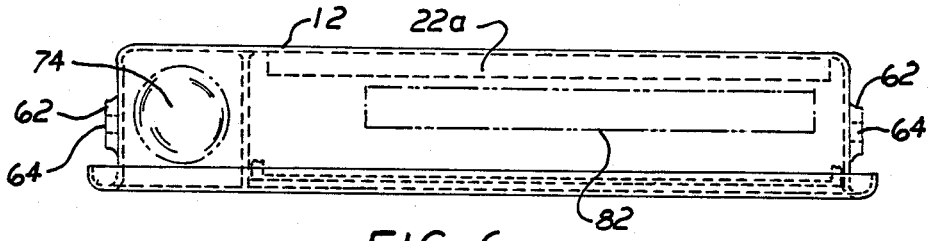
FIG. 6 is a plan view in phantom of the alternate device of FIG. 5.
Figure 7:
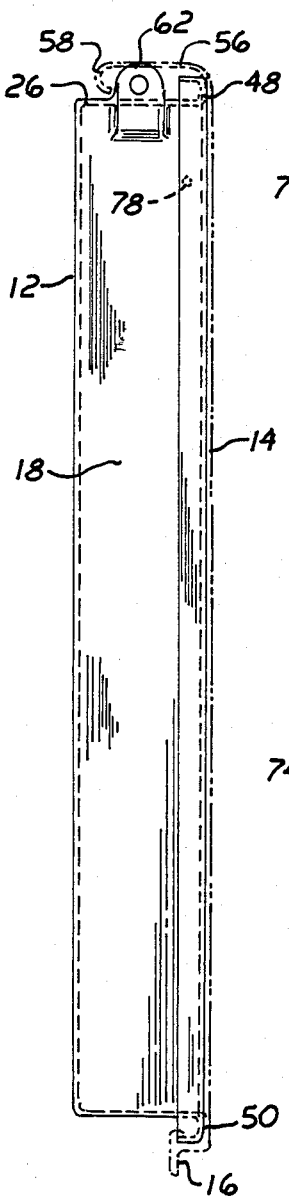
FIG. 7 is a side elevation view of the device of FIG. 5.
Figure 5:
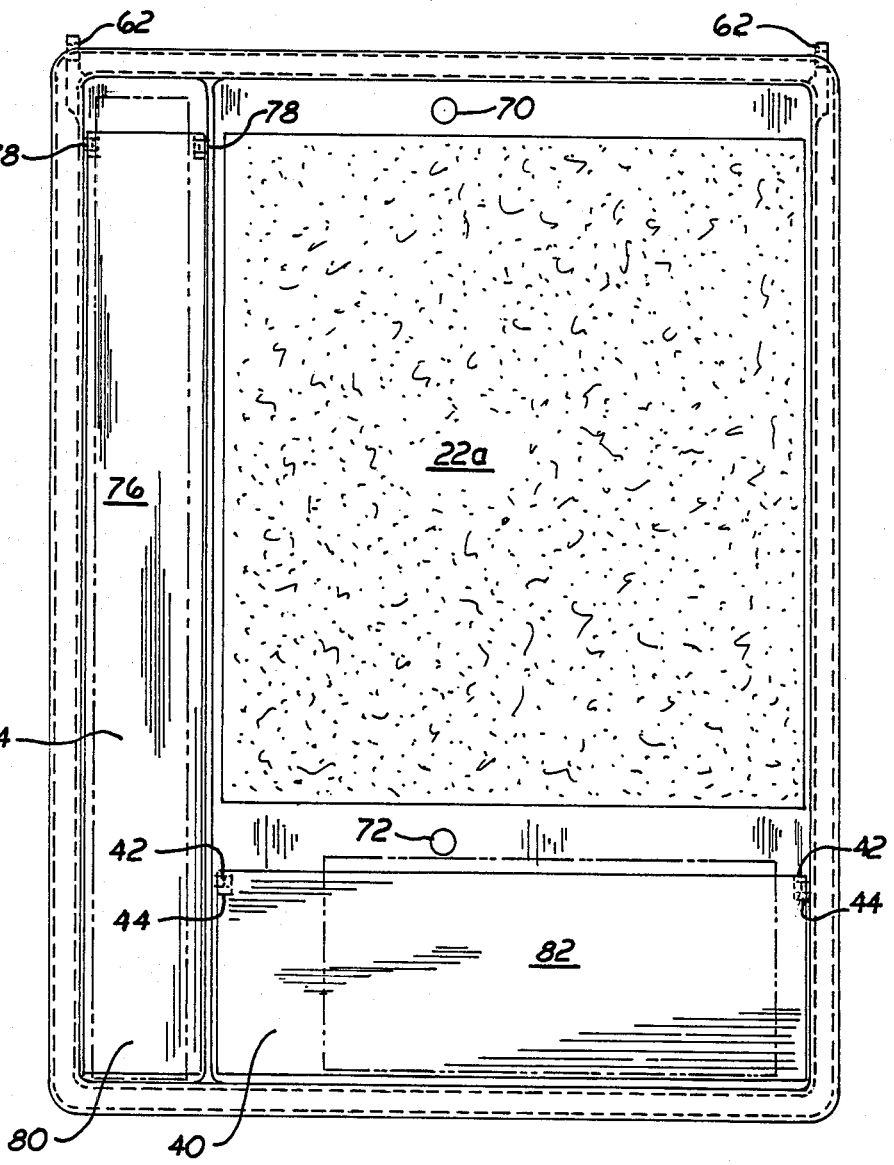
FIG. 5 is an interior elevation view partially in phantom of an alternate device of this invention.

As seen in FIG. 3, the exterior edge of top panel 26 has a u-shaped curl 48. In like manner bottom panel 28 has a U-shaped curl 50. Side panels 18 (FIG. 4) each have a U-shaped curl 52 at their exterior edges.

Covering the enclosure 20 against rain is a four sided front cover 14. The cover has integral side panels 54 at each side and an integral top panel 56 which has a curl 58 furthest from the cover face 60, which acts to cover a portion of the top of top panel 26.

Figure 8:
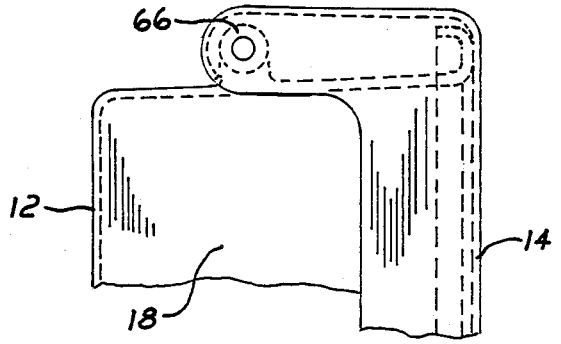
FIG. 8 is an enlarged side view of the hinging mechanism for the Assembly.
Figure 9:
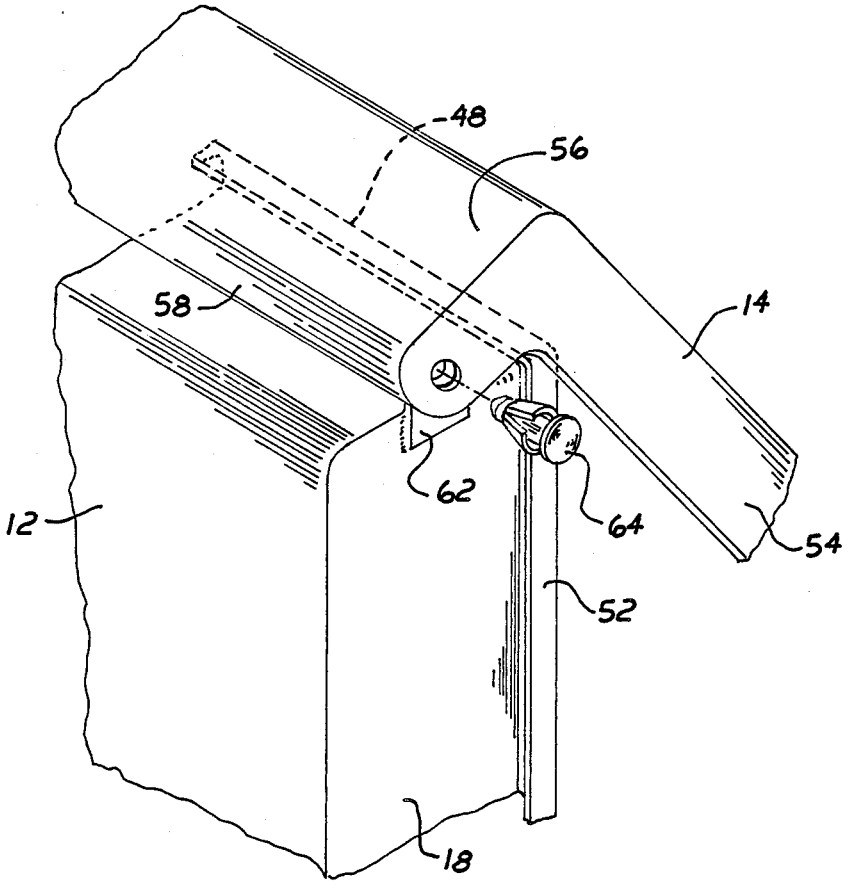
FIG. 9 is an enlarged side view of the hinging mechanism in use.

A hinge is formed on both sides 18 of the back frame 12 and the side panels 54 of the cover 14 by pushing a push pin 64 through grommet 66 located at the top of front cover 12 as seen in FIG. 8. At the top of side panels 18 is another corresponding grommet 66 receiving push pin 64. A mounting extension 62 at the top of side panel 18 is a hinge mount for the cover 16.

The bottom of cover 14 has an inward curl 68 ending in a latch tab 16 frictionally engaging the end of the U-shaped curl 50 on bottom panel 28.

Each of the U-shaped curls on the exterior edges of the back frame give slightly as the front cover 14 is pushed against them and latched to the bottom panel 28 by latch tab 16. The cover 14 fits flush and snugly against the bottom of each U-shaped curl on the back frame 12. This tight fit prevents even wind-driven water from entering the enclosure 20.

Mounting means such as holes 70 and 72 are provided to attach the assembly to a post or other available device in the area of the construction site.

In an alternate embodiment the tack board 22A can be reduced in size to provide room for a blue print chamber 74. This chamber has a cover 76 hinged 78 near the top so the cover 76 can be used to hold front cover 14 open. This is accomplished by inserting the end 80 of the cover 76 into curl 68 when cover 12 is open. A second pocket plate 82 can be hung behind plate 40.

Figure 10:
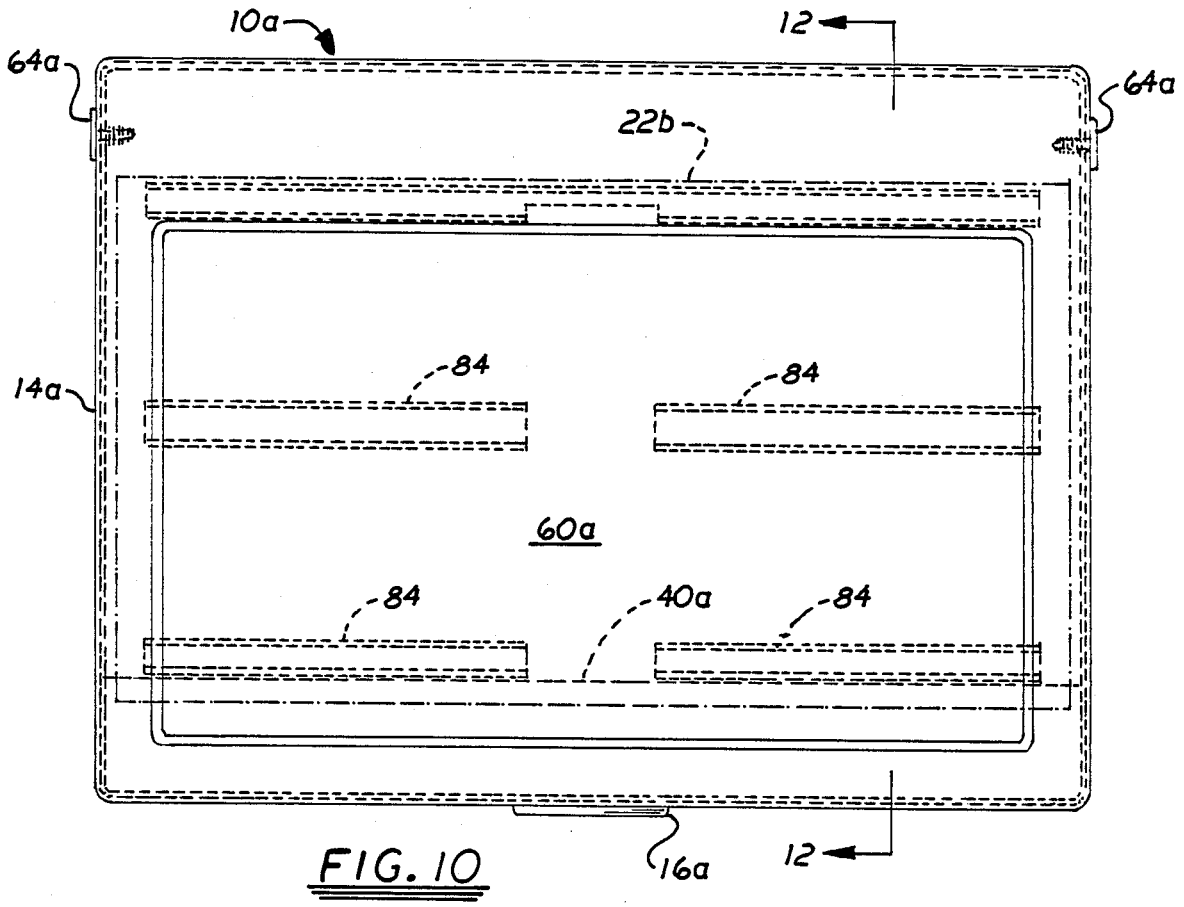
FIG. 10 is a front elevation view partially in phantom of an alternate embodiment of the invention.
Figure 11:
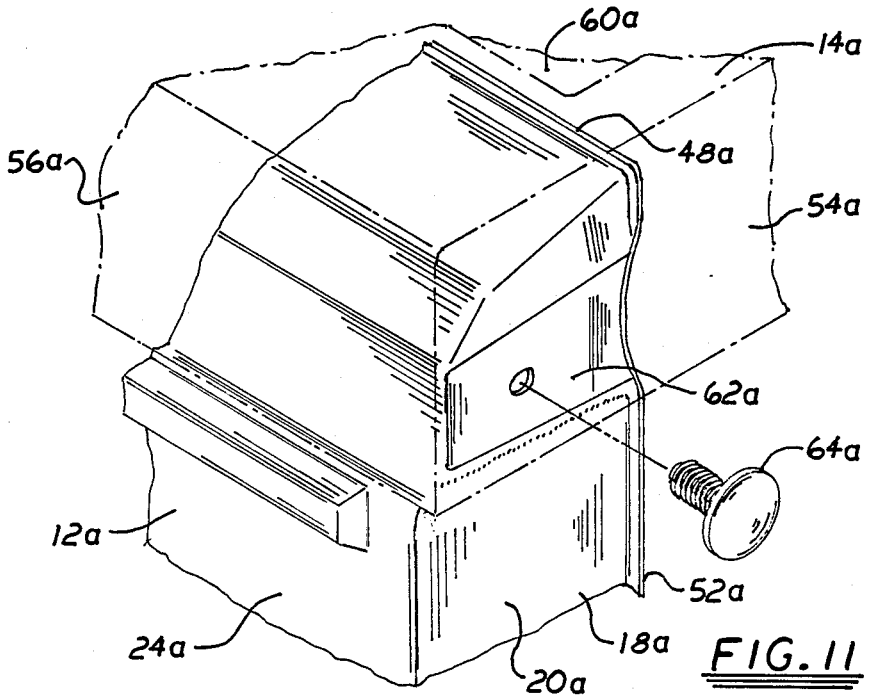
FIG. 11 is an enlarged side view of the hinging mechanism employed in the alternate embodiment of the invention shown in FIG. 10.
Figure 12:
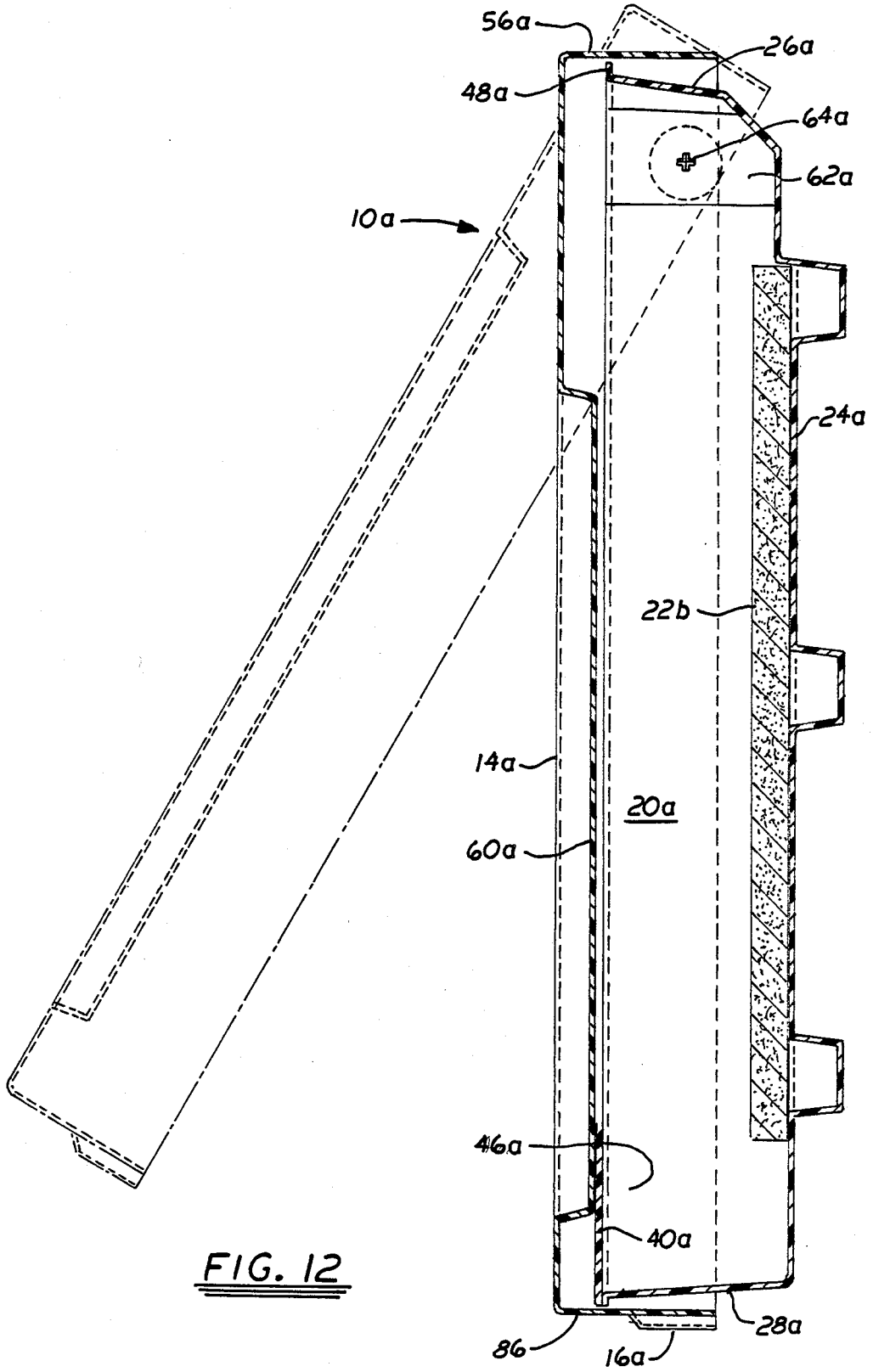
FIG. 12 is a cross section of a side elevation view partially in phantom of the FIG. 10 alternate embodiment.

An alternate inspection board assembly **10*a* is shown in FIG. 10–12. The assembly 10*a* has a four side cover 14*a* which hinges at a top extension 62*a* from side panel 18*a* of the back frame 12*a***.

The back frame **12*a* contains an enclosure 20*a* with back panel 24*a* supporting a tack board 22*b*. The side panels 18*a*, the back panel 24*a*, top panel 26*a* and bottom panel 28*a* are all integral components to form the enclosure 20*a* within the back frame 12*a***.

The top panel **26*a* has an outwardly extending curl 48*a* and the side panels 18*a* have an outwardly extending curl 52*a*. The back panel 24*a* has several ribs 84** for added strength.

A pocket plate **40*a* is mounted substantially perpendicular to the bottom panel 28*a* along its exterior edge and along the bottom exterior edges of the two side panels 18*a*. The pocket plate 40*a* forms a pocket 46*a*** for use in retaining loose documents.

The cover **14*a* has integral components including side panels 54*a*, top panel 56*a*, cover face 60*a* and bottom panel 86. Bottom panel 86 also has an optional latch plate 16*a*. The cover 14*a* is held in place by push pin 64*a*. The front surface of cover face 60*a* can be used to display the name of the user of the assembly. A 2×4 post will fit easily between ribs 84** so that the assembly can be screwed or nailed flat to the upright post for ease of display.

Minor modifications and equivalent elements can be substituted in the construction board assembly without departing from the invention as described herein.

Having thus described the invention what is claimed as new and desired to be secured by Letters Patent is:

1. A weatherized display device comprising:

(a) a back frame enclosure having two side members, a top member and a bottom member, all integral at an interior edge with a back member, each side member having an outwardly projecting curl at an exterior edge, the top member having an upwardly projecting curl at an exterior edge, the bottom member having a downwardly projecting curl at an exterior edge;

(b) a tack board mounted on an interior surface of the back member;

(c) a pocket plate mounted perpendicular to the bottom member and engaged to at least a portion of each side member;

(d) a four-sided cover hinged on an exterior upper surface of each back frame side member, the cover pressing against the bottom of each curl on the top member and side members of the back frame;

(e) means for displaying an identifying sign on an exterior surface of the cover; and (f) means for mounting the display device on a display surface for ease of access.

2. The weatherized display device according to claim 1 wherein the four-sided cover has a curled edge on its top side overlapping the back frame top member.

3. The weatherized display device according to claim 1 wherein an elongated vertical box is mounted in the back frame enclosure, the box having a cover hinged near the top of the back frame enclosure.

4. The weatherized display device according to claim 1 wherein a second pocket plate is mounted interior to the pocket plate, the pocket plates being made of clear plastic to facilitate reading documents placed behind the pocket plates.

5. The weatherized display device according to claim 1 wherein the tack board is cork.

6. The weatherized display device according to claim 1 wherein the tack board is homasote.

7. The weatherized display device according to claim 1 wherein the tack board is high density polystyrene.

8. The weatherized display device according to claim I wherein the means for mounting the display device are multiple mounting holes in the back frame back member.

9. The weatherized display device according to claim 1 wherein each upper side surface of the back member and cover have corresponding grommets for receiving a push pin to provide the hinge.

10. The weatherized display device according to claim 1 wherein a mounting rod joins the two side members and there is a groove in the interior surface of the bottom member.

11. The weatherized display device according to claim 10 wherein the pocket plate is engaged at a first end in the groove and at a second end fastened to the mounting rod.

12. The weatherized display device according to claim 1 wherein the pocket plate is mounted over the exterior edge of the bottom member.

* * * * *